US006578808B1

(12) United States Patent
Bertagni et al.

(10) Patent No.: US 6,578,808 B1
(45) Date of Patent: Jun. 17, 2003

(54) MOUNTING ASSEMBLY FOR MOUNTING A DEVICE IN A BARRIER

(75) Inventors: Alejandro Bertagni, Lake Forest, CA (US); Eduardo Bertagni, Tustin, CA (US); Richard Jung, Laguna Niguel, CA (US); Joie Puckett, Long Beach, CA (US); Dennis Grudt, Long Beach, CA (US)

(73) Assignee: Sound Advance Systems, Inc., Santa Ana, CA (US)

( * ) Notice: Subject to any disclaimer, the term of this patent is extended or adjusted under 35 U.S.C. 154(b) by 0 days.

(21) Appl. No.: 10/172,828

(22) Filed: Jun. 13, 2002

(51) Int. Cl.[7] ..... B42F 13/00
(52) U.S. Cl. ..... 248/343; 381/188; 381/205
(58) Field of Search ..... 248/342, 343, 248/317; 381/391, 188, 205, 124, 150, 148

(56) References Cited

U.S. PATENT DOCUMENTS

| | | | | |
|---|---|---|---|---|
| 3,912,865 A | | 10/1975 | Seebinger | 381/124 |
| 4,760,510 A | | 7/1988 | Lahti | 362/365 |
| 5,574,796 A | | 11/1996 | Keezer | 381/188 |
| 5,690,423 A | | 11/1997 | Hentz et al. | 362/365 |
| 5,931,432 A | * | 8/1999 | Herold et al. | 248/343 |
| 5,937,073 A | | 8/1999 | Van Gieson | 381/391 |
| 5,941,625 A | * | 8/1999 | Morand | 362/148 |
| 6,283,430 B1 | * | 9/2001 | Schubert et al. | 248/343 |
| 6,345,800 B1 | * | 2/2002 | Herst et al. | 248/342 |

FOREIGN PATENT DOCUMENTS

| | | |
|---|---|---|
| JP | 59004400 | 11/1994 |

* cited by examiner

*Primary Examiner*—Ramon O. Ramirez
(74) *Attorney, Agent, or Firm*—Sheppard, Mullin, Richter & Hampton LLP

(57) ABSTRACT

A mounting assembly for mounting a device, such as a loudspeaker enclosure, through an opening in a barrier, such as a ceiling or wall of a room, including a support for positioning on the back side of the barrier adjacent the barrier opening, and at least one spring having a first end attached to the support and a second end configured for freedom of movement. The spring is held in a set position by a set latch on the support until the device is inserted through the opening and selectively engages the spring, whereupon the second end of the spring is released to allow the spring force to act on the device in a manner tending to pull the device further through the opening, toward the back side of the barrier, and into a mounted position relative to the barrier. For dismounting the device, the second end of the spring may be inserted into a retaining latch on the support by selective engagement of the spring by the device. The support includes a plurality of support members that are pivotally joined together in a manner allowing the support to be partially collapsed for insertion through the opening in the barrier and reopened on the back side.

19 Claims, 7 Drawing Sheets

FIG. 8
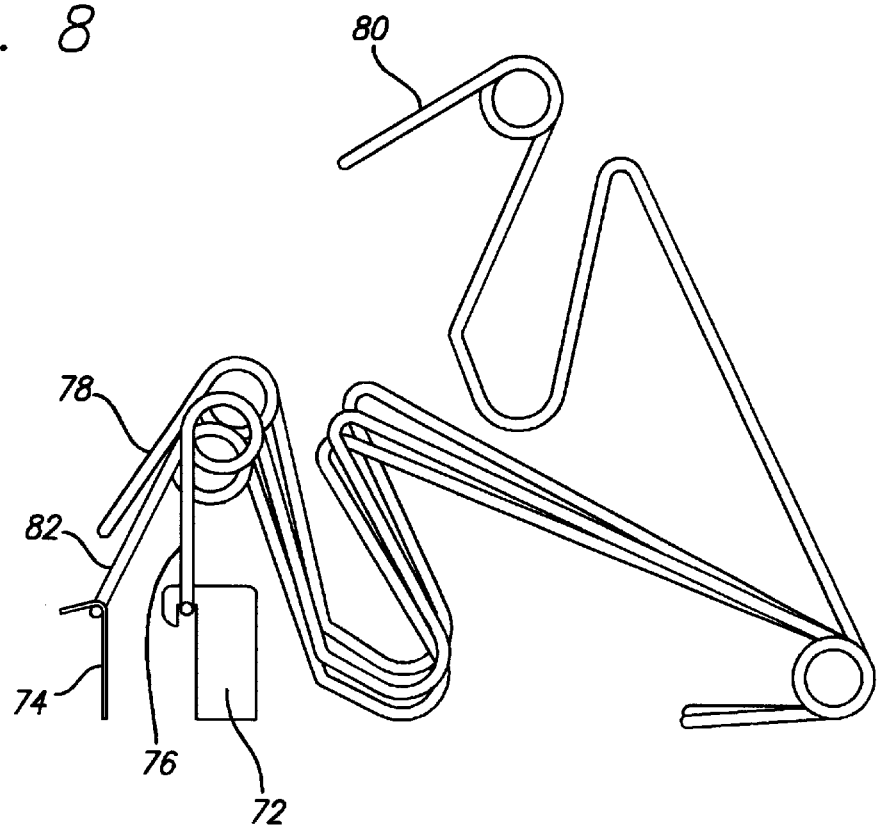
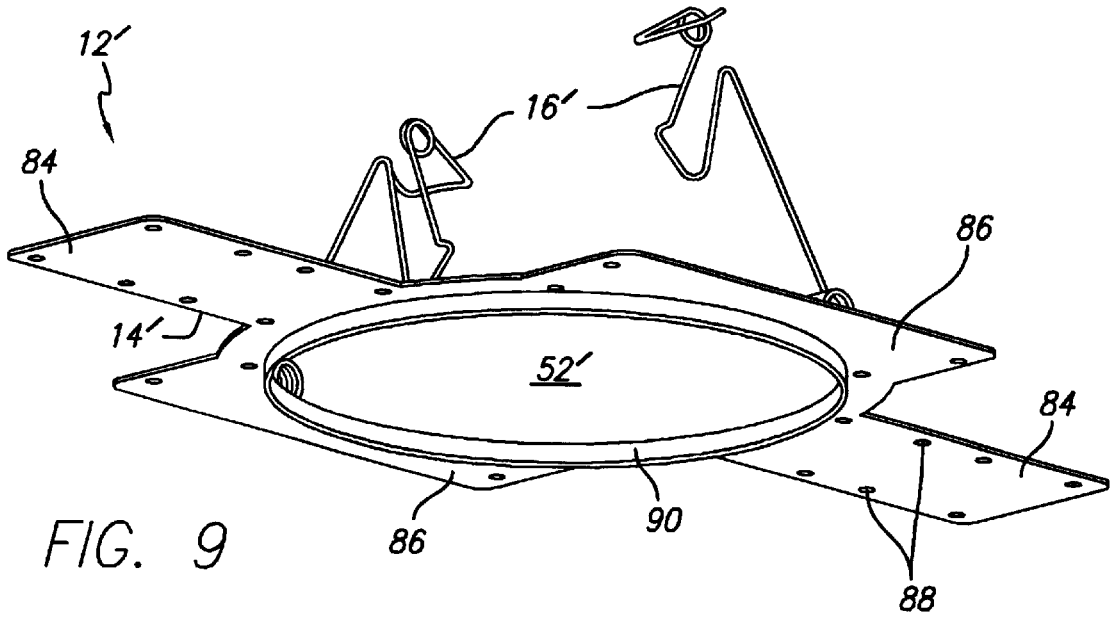
FIG. 9

MOUNTING ASSEMBLY FOR MOUNTING A DEVICE IN A BARRIER

FIELD OF THE INVENTION

The present invention relates generally to assemblies for mounting devices in barrier and, more particularly, to the mounting of a device such as a loudspeaker or other appliance in a ceiling or wall of a room.

BACKGROUND OF THE INVENTION

For both pragmatic and aesthetic reasons, devices such as loudspeakers, lighting fixtures, exhaust fans and other appliances have long been mounted in barriers, e.g., a wall, ceiling or similar structure. Typically, such devices are installed within an opening in the barrier such that the front of the device for emitting sound or light, or admitting air, is exposed on the front side of the barrier surface, and the main part of the device is hidden from view behind the barrier.

Various approaches have been used to achieve this result. In new construction, a support for the device may be permanently attached to the underlying structure of the barrier, such as the ceiling joists or wall studs, before the barrier (e.g., wallboard or other material lining the structure) is in place. An opening for the device can be formed during or after installation of the barrier. In existing construction, an opening can be formed in the barrier, and the support for the device may then be inserted through the opening from the front side and positioned for holding the device. In this case, the support may have to be in some state of disassembly to allow it to pass through the opening, and thus may require blind assembly on the back side of the barrier. In both types of construction, the support typically is positioned adjacent to the opening on the back side of the barrier, and the device can then be installed through the opening, using a spring or springs between the support and the device for urging a flange, frame bezel or other surround around the periphery of the front of the device flush against the front side of the barrier.

Current approaches commonly have springs that are exposed during installation of the device and require direct handling and manipulation by the installer to connect the springs to the device while holding it near the opening in the barrier. These types of spring configurations may make installation awkward and pose a safety risk, particularly when mounting devices in high ceilings. Difficulties also may arise when retrofitting an existing room barrier, for example, in installing the support on the back side of the barrier. Such installations typically require the installer to perform steps on the hidden side of the barrier, which, again, may be awkward when mounting devices in high ceilings. Also, it may be relatively difficult to dismount such a device for maintenance, repair or replacement, for example, because of the need to disconnect the springs while holding the device near the opening.

Accordingly, there is a need for an improved mounting assembly for mounting devices such as loudspeakers and lighting fixtures in a room barrier that overcomes the aforementioned difficulties, allowing for easy installation of the device without requiring the installer to directly handle and manipulate the springs, and that allows for easy dismounting and remounting of the device for maintenance, repair or replacement. The present invention fulfills these needs.

SUMMARY OF THE INVENTION

Briefly, and in general terms, the present invention resides in a mounting assembly for mounting devices, including loudspeakers, lighting fixtures, fans and other appliances and their enclosures, in a barrier, such as a ceiling or wall, through an opening in the barrier from its front side. The mounting assembly of the present invention comprises a support for positioning on the back side of the barrier adjacent the barrier opening, and at least one spring having a first end attached to the support, and a second end configured for freedom of movement. The spring has at least two positions: a set position in which the second end of the spring is releasably latched with the spring in a compressed or loaded condition, and an installed position in which the second end of the spring is released to allow the spring force to act on the device for mounting it. The spring moves from its set position to its installed position by inserting the device at least partially through the opening, and selectively engaging the spring with some portion of the device in such a manner that it releases the spring to exert a force on the device, tending to pull it further through the opening, toward the back side of the barrier, and into a mounted position relative to the barrier. Advantageously, the installer does not need to directly manipulate and connect the spring to the device while holding it close to the opening, and the operational range of motion of the spring, including the set position and the installed position, may be confined entirely to the back side of the barrier.

More specifically, in a presently preferred embodiment, by way of example and not limitation, the mounting assembly may include a support having one or more springs with a first spring end affixed to the support, a second spring end configured to have freedom of movement, a first spring coil positioned adjacent to the first spring end, and an engagement portion located intermediate the first spring end and the second spring end, for engaging a clip on the device. The support includes an install latch for holding the second spring end in a set position until the device is received at least partially through the opening from the front side of the barrier, and the clip engages the engagement portion of the spring on the back side of the barrier. By manipulating the device from the front side, such by as pulling down on it, or rotating it, the clip selectively causes the second spring end to release from the install latch, allowing the engagement portion of the spring to lift and maintain the device by its clip in a mounted position.

In a detailed aspect of a preferred embodiment of the invention, the spring further includes a second spring coil adjacent to the second spring end and configured to urge the second spring end clear of the install latch upon release of the spring, to facilitate movement of the spring from its set position to its installed position.

In another detailed aspect of a preferred embodiment, the support further includes a retaining latch configured to receive and hold the second end of the spring in a dismount position, to enable dismounting the device without requiring direct handling of the second spring end by the installer. The second end of the spring may be inserted into the retaining latch by selective engagement of the spring by the device, which has the effect of relieving the force exerted by the spring on the device.

In yet another detailed aspect of a preferred embodiment, the support may be at least partially collapsed for insertion through the opening from the front side of the barrier, and then reopened and positioned on the back side of the barrier, without need for blind assembly of individual components. In a presently preferred embodiment, the support comprises a plurality of support members that are joined together in a manner allowing them to pivot relative to one another.

Other features and advantages of the invention will become apparent from the following description of the preferred embodiments, taken in conjunction with the accompanying drawings, which illustrate, by way of example, the principles of the invention.

BRIEF DESCRIPTION OF THE DRAWINGS

The invention will now be described with reference to the presently preferred embodiments shown in the drawings, which are provided only as examples to illustrate the principles of the invention. The invention is not limited to the embodiments shown, and variations will be apparent to those skilled in the art. The embodiments are not shown or described in more detail than necessary to describe the invention, and the manner and process of making and using it, to those skilled in the art.

In the drawings:

FIG. 8 is an diagrammatic view showing the range of motion of the spring of the mounting assembly depicted in FIG. 1; and FIG. 9 is a perspective view of an alternative embodiment of the mounting assembly of the present invention shown from the front side of the support.

DESCRIPTION OF THE PREFERRED EMBODIMENTS

Figure 1:
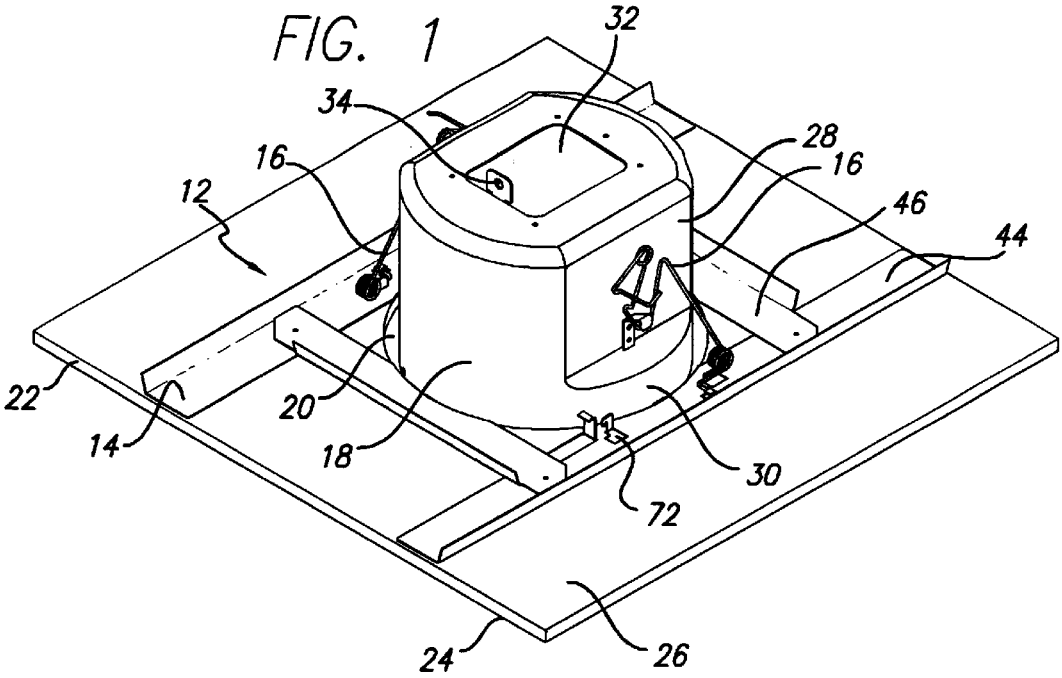
FIG. 1 is a perspective view of a preferred embodiment of a mounting assembly, including a support and springs, positioned on a back side of a ceiling relative to a room adjacent to an opening in the ceiling, and a loudspeaker enclosure held in a mounted position by the springs.
Figure 1A:
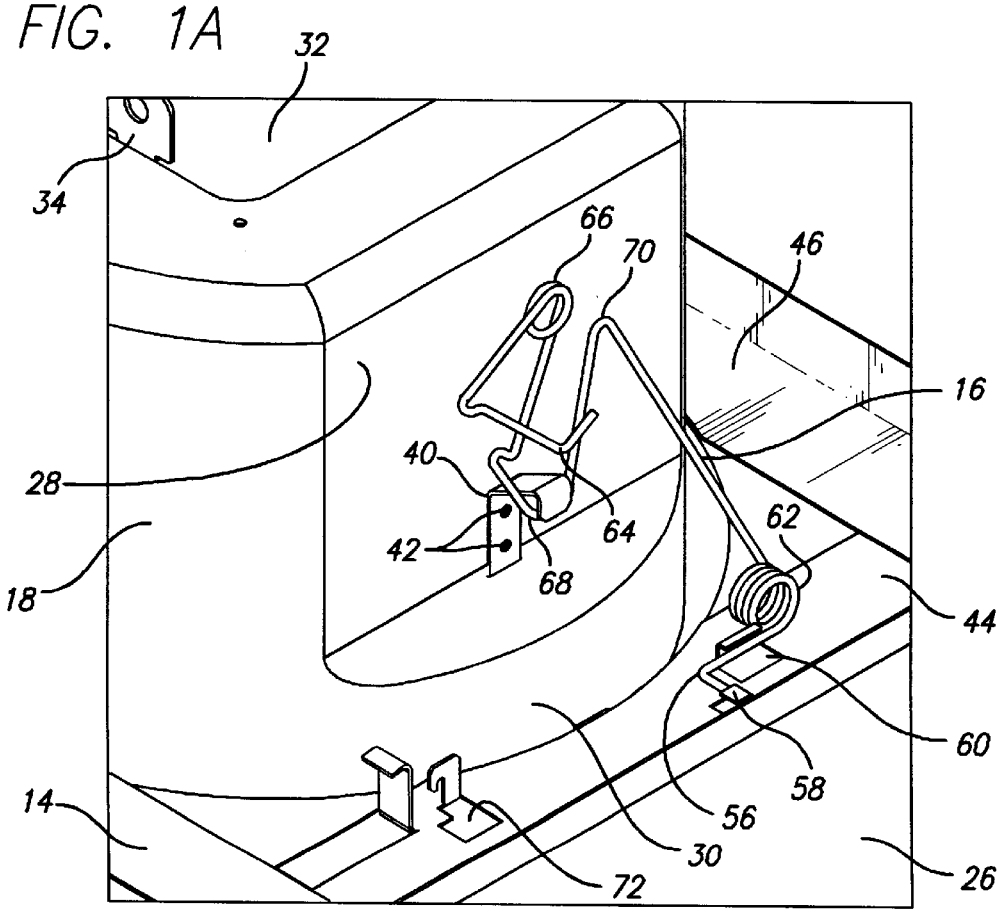
FIG. 1A is an enlarged, partial perspective view of the mounting assembly and loudspeaker enclosure of FIG. 1, showing one of the springs on the support engaging a clip on the enclosure to hold it in a mounted position.

Referring now to the drawings, and particularly to FIGS. 1 and 1A thereof, there is shown a mounting assembly 12 in accordance with a preferred embodiment of the present invention comprising a support 14 with a pair of springs 16 (only one of which is fully visible in FIGS. 1 and 1A) for mounting a device in a barrier. Although the mounting assembly is suitable for mounting a variety of devices, including lighting fixtures, exhaust fans and other appliances, for convenience it will be described with reference to mounting an enclosure 18 containing a loudspeaker in an opening 20 of a ceiling 22 that has a front or finished side 24 exposed to a room and a back or unfinished side 26 hidden from the room.

In the preferred embodiment, the enclosure 18 is in the form of a generally cylindrical housing having flat sides 28 above the base portion 30 of the enclosure at its front end. The enclosure is open at its front end and is substantially closed and sealed at its rear end, with a separate compartment 32 for a loudspeaker transformer or the like (not shown) formed in the rear surface that includes a removable closure (also not shown) for access to the compartment, with a fitting for passage of speaker wires or other electrical connections. A safety tab 34 also is provided on the rear surface for possible use in suspending the enclosure from a structural member for compliance with building codes or added safety. The enclosure may be formed of aluminum or any other material that complies with applicable building codes. The loudspeaker may be of the planar diaphragm type such as shown and described in connection with FIGS. 1–3 of U.S. Pat. No. 5,539,835, which is hereby incorporated by reference, although the speaker itself forms no part of the present invention. As shown in FIG. 3, the speaker is pre-installed in the enclosure, and the exposed front of the speaker comprises a circular shaped planar diaphragm 36 and a surround in the form of a frame bezel 38 having a diameter greater than the diameter of the base portion of the enclosure. Of course, the enclosure may comprise any form of housing or other device desired to be mounted in an opening in a barrier, and the enclosure may contain other types of appliances, or no appliance at all at the time of installation.

The support 14 is configured to be positioned around the opening 20 in the ceiling 22, with the springs 16 on each side of the support positioned for interconnecting between the support and clips 40 formed on each of the flat sides 28 of the enclosure 18 (FIGS. 1 and 1A). The clips are attached to the enclosure by fasteners 42, such as rivets. As used herein, the term "clip" is intended to have its ordinary meaning of any of various devices that grip, clasp or hook, and is not intended to be limited to any particular form or shape, consistent with its function as described herein. Upon selective engagement of the springs by the clips, the springs act to pull the enclosure into a mounted position relative to the ceiling, such that the enclosure is hidden from view on the back side 26 of the ceiling, with only the front of the loudspeaker and its surrounding frame bezel exposed to view. As detailed below, the mounting assembly provides easy installation of the loudspeaker to a mounted position, and allows for easy dismounting of the loudspeaker for maintenance, replacement or repair with the spring having an operational range-of-motion confined to the back side of the barrier and without requiring excessive,handling of the springs or having the springs exposed through the opening. Moreover, the mounting assembly is cost-effective to manufacture and install.

Figure 2:
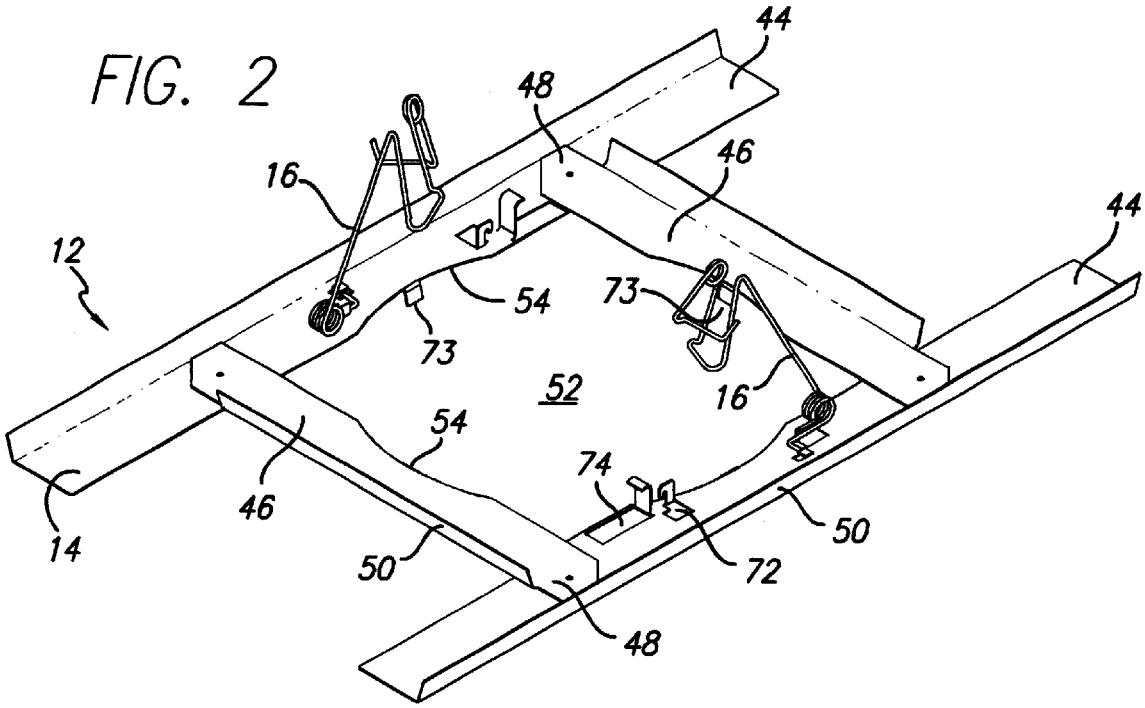
FIG. 2 is a perspective view of the mounting assembly of FIG. 1 prior to insertion through the opening in the ceiling.
Figure 3:
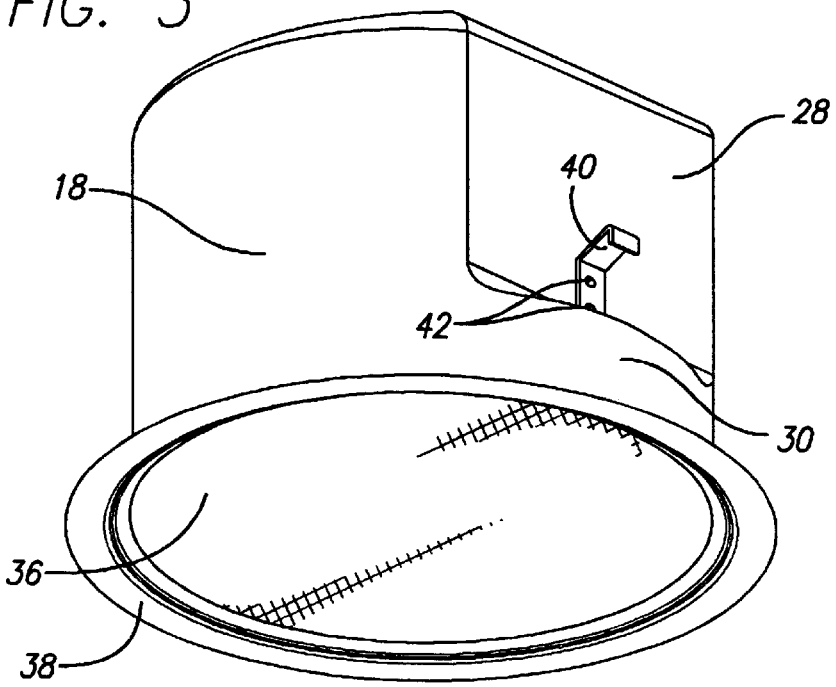
FIG. 3 is a perspective view of the loudspeaker enclosure of FIG. 1 showing a planar diaphragm surrounded by a frame bezel at the front of the enclosure.

As shown in FIG. 2, the support 14 is a generally planar structure comprising a pair of elongate members 44 that are spaced apart and joined by a pair of relatively shorter, spaced-apart cross members 46. Each cross member is joined at each of its ends to an elongate member by a single fastener 48, such as a rivet (FIG. 3), that allows the support members to pivot relative to one other for reasons discussed below. Each support member comprises a flat and relatively narrow sheet of material having a flange 50 formed along its outer edge for structural rigidity. The material for the support members may be steel, aluminum or any other material that complies with applicable building codes. When the support is properly positioned on the back side 26 of the ceiling 22 to receive the enclosure 18, the support members define a square opening 52 that overlies and surrounds the opening 20 in the ceiling. The sides of the square opening have a length somewhat less than the diameter of the generally circular base of the enclosure. To provide clearance for the base of the enclosure in the square opening of the support, an arcuate cutout 54 is formed in the mid-portion of the inner edge of each support member.

Figure 4A:
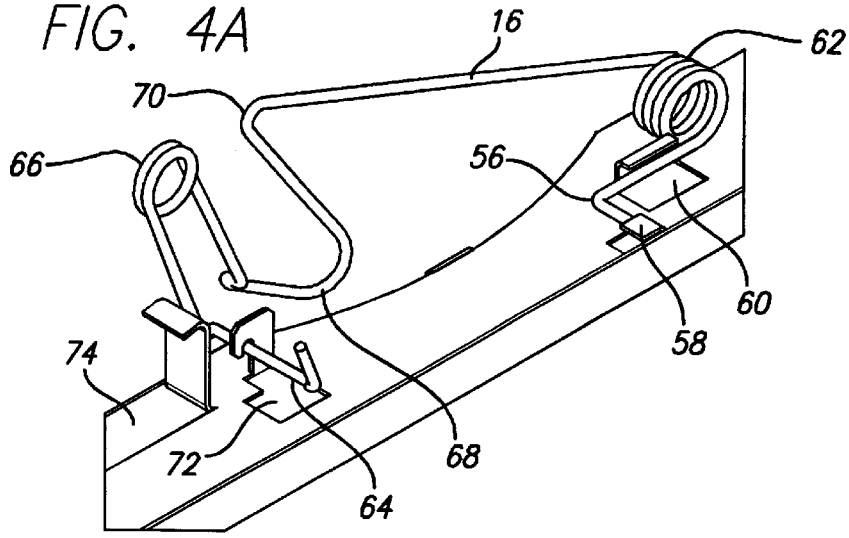
FIG. 4A is an enlarged, partial perspective view of one of the springs on the support of the mounting assembly of FIG. 1 shown in a set position with a second end of the spring in a corresponding install tab on the support.

Referring to FIG. 1A, when the enclosure 18 is fully installed and flush with the front side 24 of the ceiling 22, each spring 16 is hooked to the clip 40 on its side of the enclosure, with the spring at or near its fully retracted state (i.e., one end of its range of motion) and exerting adequate force on the enclosure to pull and maintain the enclosure in a mounted position. As seen in FIGS. 1A and 4A, each spring includes a first spring end 56 affixed to the elongate member 44 of the support by fastening tabs 58 and 60, a first spring coil 62 adjacent to the first spring end, a second spring end 64 with an upturned end portion having freedom of movement, and a second spring coil 66 adjacent to the second spring end. Intermediate the two ends of each spring are an engagement portion 68 for receiving and engaging the clips on the enclosure, and an upwardly extending loop 70 to help define the engagement portion and to serve as a stop for registering the clip with the engagement portion during insertion of the device. The upwardly extending loop is spaced from the first spring coil to provide sufficient spring length for adequate spring force and range of motion during installation and dismounting of the enclosure. The spring may be made of spring steel, and the size and length of the spring wire, including its coils, will be selected in view of the particular application, taking into account the size and weight of the enclosure, among other things.

The structure and function of the support 14 and its interaction with the enclosure 18 will be best understood through a description of the installation and dismounting processes. In this example, it is assumed that the appropriate circular opening 20 has been formed in the ceiling 22, having a diameter slightly larger than the base diameter of the enclosure and with sufficient clearance between the ceiling joists and above the ceiling opening to receive both the support and the enclosure.

Figure 4B:
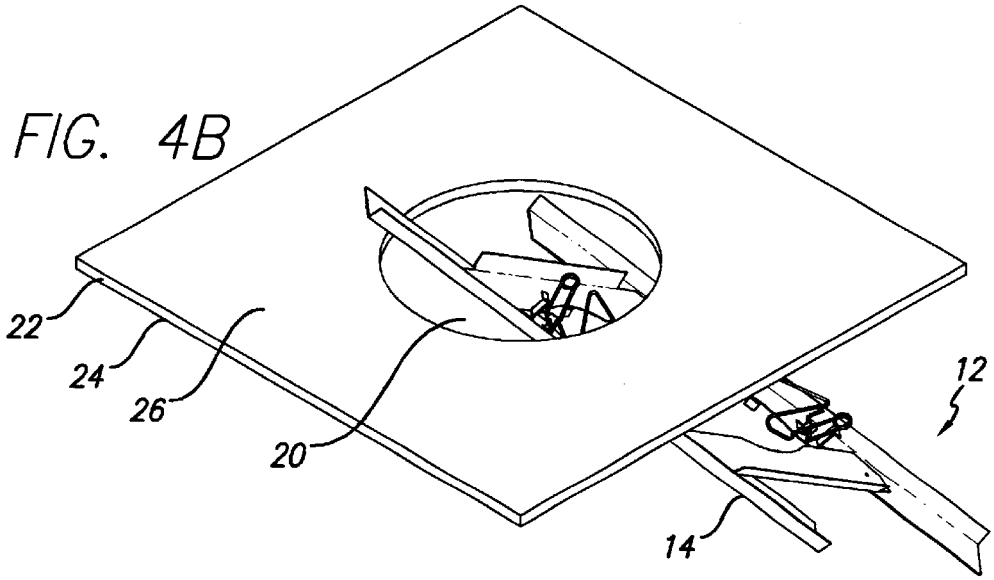
FIG. 4B is a perspective view of the mounting assembly of FIG. 1, shown partially collapsed for insertion through the opening in the ceiling.
Figure 4C:
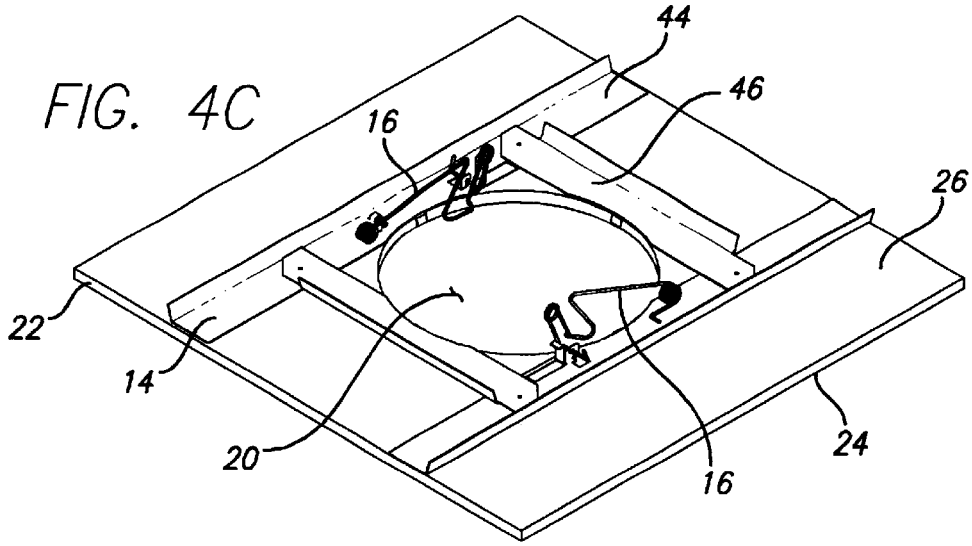
FIG. 4C is a perspective view of the mounting assembly of FIG. 1, shown positioned on the back side of the ceiling around the opening, with both springs in their corresponding install tabs.

FIGS. 4A–C illustrate preparation and positioning of the support 14 prior to installation of the enclosure 18. As shown in FIG. 4A, an install latch in the form of a hook-shaped install tab 72 is formed on each elongate member 44 of the support to receive and hold the second spring ends 64 in a set position during installation. As a first step in installation, therefore, each spring may be manually set by moving the second spring ends so that they are received and secured under their respective install tabs on the elongate members. Alternatively, this step may be deferred until the support is positioned on the back side 26 of the ceiling 22. The term "latch" is intended to have its ordinary meaning of any of various devices in which mating mechanical parts engage to fasten, but not to lock, and the term "tab" is used in the sense of a relatively short projecting device by which something may be grasped or held. Neither "latch" nor "tab" are intended to be limited to any particular form or shape, consistent with their functions as described herein.

In order to pass the support 14 through the opening 20 in the ceiling 22, the support is partially collapsed by pivoting the elongate members 44 and cross members 46 relative to one another so that the normally square opening 52 between the support members becomes a rhombus. As shown in FIG. 4B, this collapsed configuration allows the support to pass through the opening in the ceiling without need for disassembly of the support members for insertion through the opening, or for blind assembly of them on the back side 26 of the ceiling. After the support has passed completely through the opening, the support members can be pivoted back to their normal configuration, forming a square opening, and positioned to surround the opening in the ceiling, as shown in FIG. 4C. Preferably the arcuate cutout 54 on the inner edge of each support member includes an alignment tab 73 (only two of which are fully shown in FIGS. 2 and 4C) extending downwardly into the ceiling opening to aid in aligning the support and holding it in position around the opening. Once the support is aligned as shown in FIG. 4C (and the springs 16 are set, as discussed above), the mounting assembly 12 is ready to receive the enclosure.

Any required electrical connections with the enclosure 18 may now be made. For example, speaker wires (not shown) may be pulled through the ceiling opening 20, passed through a fitting on the removable closure for the compartment 32 in the rear surface of the enclosure 18, and connected to a transformer in the compartment. The removable closure may then be secured in place on the enclosure.

Figure 5:
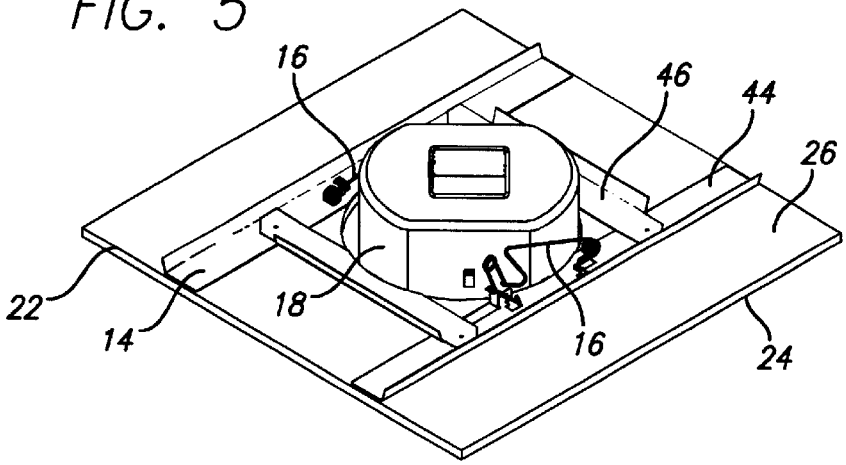
FIG. 5 is a perspective view similar to FIG. 4C, showing the orientation of the enclosure upon initial insertion into the opening of the ceiling.

The steps for installing the enclosure 18 through the opening 20 in the ceiling 22 and connecting it to the support 14 on the back side 26 of the ceiling are shown in FIGS. 5 through 7A. In FIG. 5, as the enclosure is inserted through the ceiling opening, it is held at an angle of about 30° to 45° counterclockwise (viewed from the front side 24 of the ceiling) relative to the orientation the enclosure will have on completion of the installation process, namely, with the flat sides 28 of the enclosure parallel to the elongate members 44. This is so that the clips 40 on the enclosure will clear the springs 16 on the support during insertion and will be positioned counterclockwise from the engagement portions 68 of the springs.

Figure 5A:
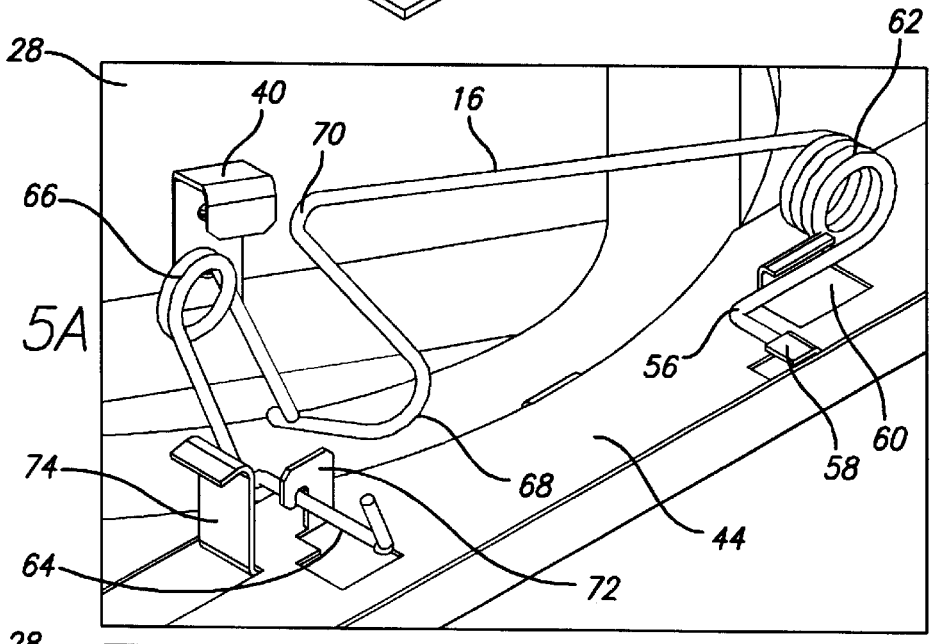
FIG. 5A is a enlarged, partial perspective view similar to FIG. 5, showing one of the clips on the enclosure approaching a corresponding spring on the support as the enclosure is rotated into position for mounting.
Figure 5B:
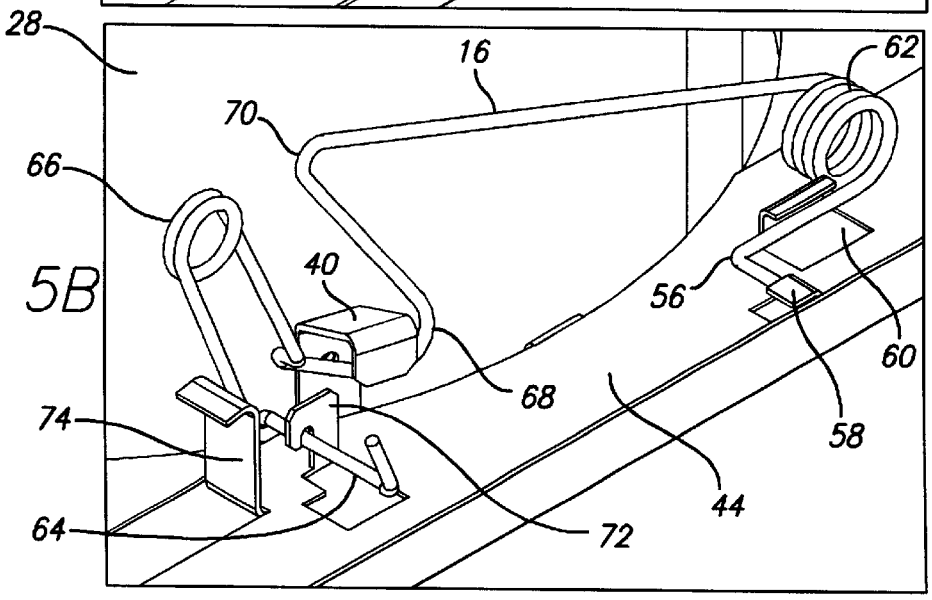
FIG. 5B is a enlarged, partial perspective view similar to FIG. 5A, showing the clip aligned with an engagement portion of the spring.

With the frame bezel 38 of the speaker held slightly below the ceiling, the installer can then rotate the frame bezel and the enclosure 18 clockwise until the clips 40 contact the springs 16 somewhere between their engagement portions 68 and their upwardly extending loops 70 (FIG. 5A). The upwardly extending loops have sufficient height and are so configured that the clips cannot be rotated past the springs. When the clips thus contact the springs, the enclosure then may be allowed to rest on the springs with the clips supported by the engagement portions of the springs as shown in FIG. 5B. The enclosure may be left in this position until installation is ready to be completed (for example, after removing any protective covering over the front of the device).

Figure 6:
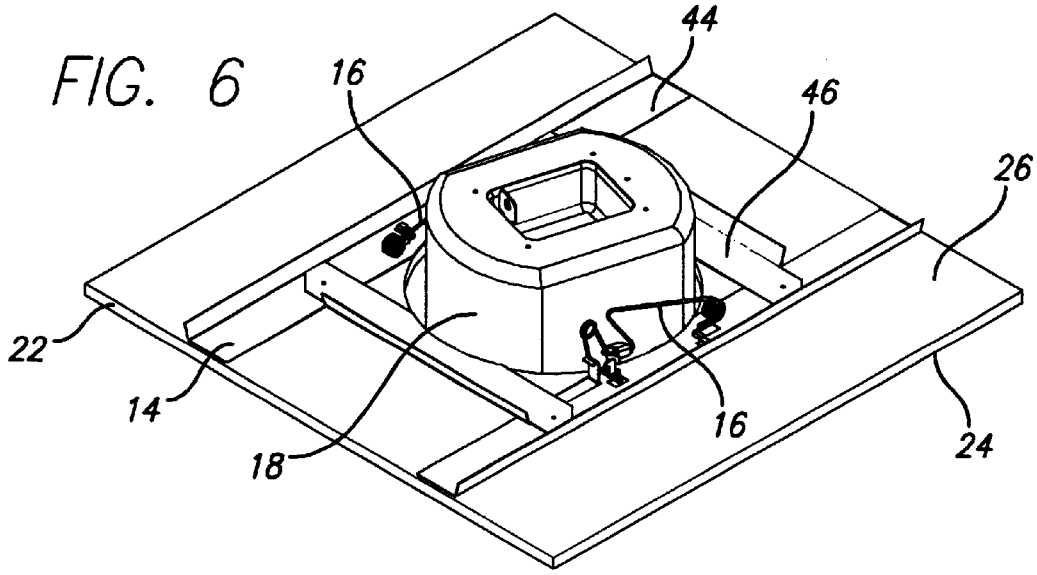
FIG. 6 is a perspective view similar to FIG. 5, showing the enclosure resting on the springs, with the clips on the enclosures received in the engagement portions of the springs.
Figure 6A:
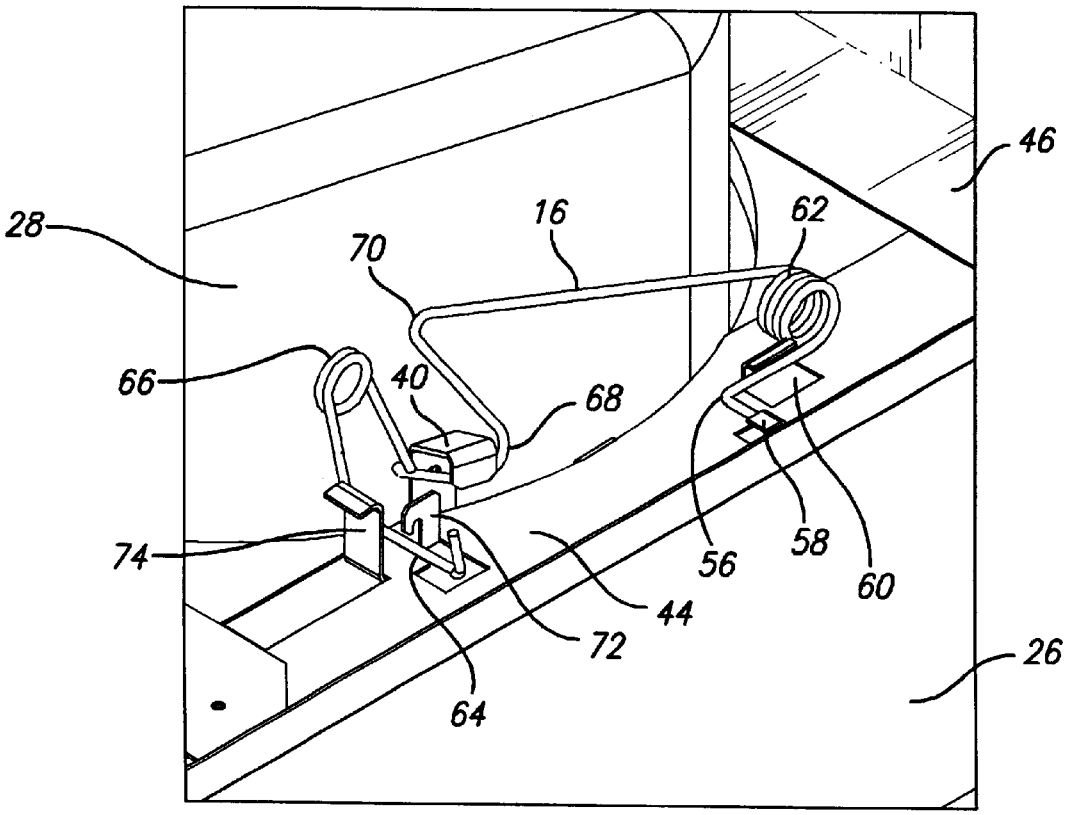
FIG. 6A is an enlarged, partial perspective view similar to FIG. 6, showing the enclosure pulled down to release the second end of the spring from the install tab.

The installation process is completed by grasping and pulling down on the frame bezel 38 sufficiently to cause the clips 40 on the sides of the enclosure 18 to pull down on the engagement portions.68 of the springs 16 to dislodge the second spring ends 64 from their respective install tabs 72, as shown in FIGS. 6 and 6A. As a result of this selective engagement by the clips and dislodgement of the second spring ends, the second spring ends are urged in the counterclockwise direction by the second spring coils 66, causing the second spring ends to spring clear of the install tabs. At the same time, the second spring ends and the engagement portions of the springs are urged upwardly and in the clockwise direction primarily by force of the first spring coils 62. The forces thus exerted by the springs on the clips 40, cause the enclosure to rotate into its final angular orientation with the flat sides 28 of the enclosure parallel to the elongate support members 44, and to be drawn into a flush-mounted position with the ceiling, as shown in FIGS. 1 and 1A.

It will be appreciated from the foregoing that the installation process does not require the installer to directly manipulate and connect springs to an enclosure while holding the enclosure near an opening in a ceiling. Instead, the installer need merely set the springs on the support prior to or after inserting it through the ceiling opening, and then insert the enclosure through the opening to engage and trigger the springs into operative position with a simple rotational and pulling motion. Further, the support can be inserted through the opening and positioned on the back side of the ceiling in one-piece, so as to avoid any need to for blind assembly of the support on the back side of the ceiling. In the particular example described, the mounting assembly can accommodate ceilings having a range of thickness from about ⅜ inch to about 1¼ inches.

Figure 7A:
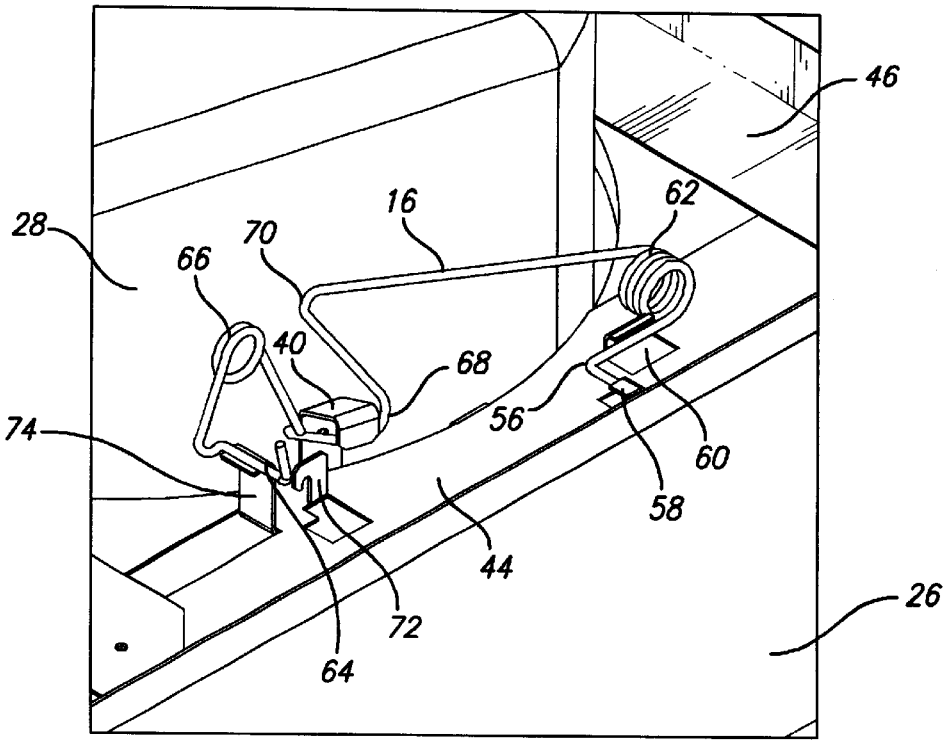
FIG. 7A is an enlarged, partial perspective view showing the enclosure being dismounted by pulling down on the enclosure to cause the clips to pull the second ends of the springs toward retaining tabs on the support.
Figure 7B:
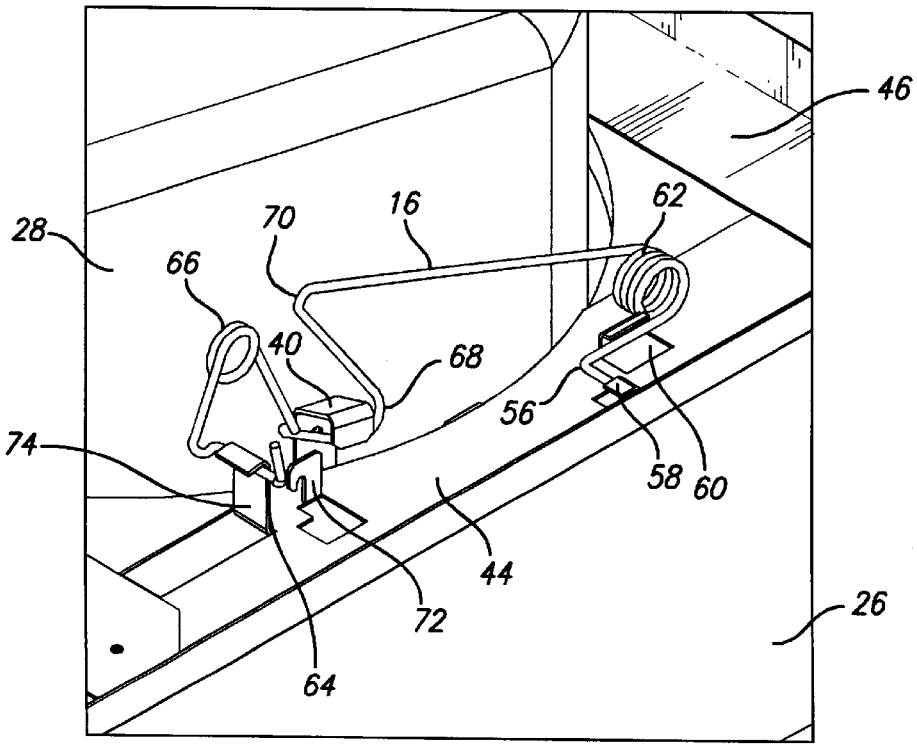
FIG. 7B is an enlarged, partial perspective view similar to FIG. 8A showing the second end of the spring received in the retaining tab.

The process of dismounting the enclosure 18 is likewise simple and straightforward, as illustrated by FIGS. 7A–B. To dismount the enclosure, first the frame bezel 38 is grasped and pulled down so that the clips 40 on the sides of the enclosure pull down on the engagement portions 68 of the springs 16. This, in turn, causes the second end 64 of each spring to move downwardly and in a counterclockwise direction until it is received in and secured by a retaining latch in the form of a hook-shaped retaining tab 74 on the support. The support includes a retaining tab positioned adjacent to each install tab 72 on the elongate members 44, such that the retaining tab is substantially aligned with the second end of the spring in its relaxed state as it is pulled down toward the support. Each retaining tab is positioned to receive the corresponding second spring end at, or near, the bottom of the spring's range of motion and is configured to guide the second spring end to a secured position in the retaining tab without direct handling of the springs by the installer.

When the second spring ends 64 are in the secured position in the retaining tabs 74 (FIG. 7B), the enclosure 18 can be rotated in a counterclockwise direction to disengage its clips 40 from the springs 16 and remove the enclosure by pulling it down through the opening 20 in the ceiling 22. Finally, to prepare for re-installation of the enclosure after maintenance, repair or replacement, the installer can reach into the ceiling opening to manually free the second spring ends from the retaining tabs and move them to the install tabs 72, so that the springs are once again set in the same manner as shown in FIG. 4C in preparation for initial installation of the support.

FIG. 8 shows by way of summary the operational range of motion of the springs 16, including a set position 76, a free position 78, an installed position 80, and a dismount position 82. In the set position, the second ends 64 of the springs are secured under the install tabs 72, with the second spring coils 66 in maximum torsion and the first spring coils 62 in a relatively high state of torsion as well. The free position is a transitory state where the second spring ends are freed from the install tabs, allowing the second spring coils to fully relax and cause the second spring ends to clear the install tabs. As can be seen, the second spring ends substantially align with the retaining tabs in the free position for purposes of subsequently dismounting the enclosure 18. In the installed position, the first spring coils are released to lift and rotate the enclosure into a mounted position relative to the ceiling 22. In the dismount position, the second spring ends are secured in the retaining tabs 74, with the first spring coils in.maximum torsion. It will be appreciated that in these various positions in which one or more portions of the springs are in relatively high torsion, the springs may remain on the back side of the ceiling, thereby reducing risk of injury during installation and removal of the loudspeaker.

Those skilled in the art will appreciate that the springs and their respective install tabs and retaining tabs may be positioned on the cross members instead of on the elongate members of the support. It also will be appreciated that the install tabs and the retaining tabs do not have to be separate from one another, but could be combined into a single tab structure having an install tab portion and a retaining tab portion. The first spring coil may be omitted or have a different form depending on the nature, size and weight of the device being mounted. The second spring coils also may be omitted or have a different form, provided that the springs, the install tabs and the retaining tabs are positioned and configured such that upon release of the second spring ends during installation, the second spring ends spring clear of the install tabs and into substantial alignment with the retaining tabs for purposes of subsequent dismounting of the device.

An alternate embodiment of a mounting assembly 12' is shown in FIG. 9, including a planar support 14' intended primarily for use in new construction, in which the support can be secured to ceiling joists, wall studs or other underlying structure before a barrier (e.g., wallboard) is installed. The support may be formed from a continuous sheet of material, such as steel or aluminum, with rectangular wings 84 and 86 radiating outwardly in a cross shape from a circular opening 52' formed in the center of the support. Each of the wings has holes 88 to allow mounting with nails, screws or the like. The opening is surrounded by a flange 90 to serve as an integral mud ring. The circular opening, of course, is sized to receive an enclosure or other device to be mounted. A pair of springs 16', install tabs (not shown) and retaining tabs (also not shown), similar to those described above with reference to support 14 (FIG. 2), are mounted on the top or back side of the planar support for mounting an enclosure in accordance with the invention.

The foregoing detailed description of the present invention is provided for the purposes of illustration and is not intended to be exhaustive or to limit the invention to the precise embodiments disclosed. Accordingly, the scope of the present invention is defined by the following claims.

We claim:

1. A mounting assembly for mounting a device in an opening in a barrier from a front side thereof, the assembly comprising:

a support configured for positioning on a back side of the barrier adjacent to the opening in the barrier; and a spring having a first end, a second end and an engagement portion intermediate the first end and the second end, the first end of the spring affixed to the support, the support including a set latch for releasably securing the second end of the spring to the support, the second end of the spring released from the set latch by at least partial insertion of the device through the opening from the front side of the barrier and selective engagement of the spring by the device, whereupon release of the second end of the spring from the set latch the spring exerts a force on the device through the engagement portion of the spring tending to pull the device toward the back side of the barrier and into a mounted position.

2. A mounting assembly as set forth in claim 1, wherein the device engages the spring only upon insertion of the device at least partially through the opening from the front side of the barrier.

3. A mounting assembly as set forth in claim 1, wherein a portion of the spring is configured to serve as a stop for registering the clip with the engagement portion during insertion of the device.

4. A mounting assembly as set forth in claim 1, wherein the device includes a clip for engaging the engagement portion of the spring.

5. A mounting assembly as set forth in claim 1, wherein the spring has a range of motion between a set position in which the second end of the spring is releasably secured in the set latch, and an installed position in which the second end of the spring is released from the set latch and the engagement portion of the spring exerts a force on the device tending to pull the device through the opening and into a mounted position relative to the barrier, and the motion of the spring is confined to the back side of the barrier.

6. A mounting assembly as set forth in claim 1, wherein the spring further includes a first spring coil between the first end of the spring and the engagement portion of the spring, the first spring coil exerting a force on the device through the engagement portion of the spring tending to pull the device through the opening and into a mounted position relative to the barrier.

7. A mounting assembly as set forth in claim 6, wherein the spring further includes a second spring coil between the second end of the spring and the engagement portion of the spring, the second spring coil exerting a force tending to move the second end of the spring away from the set latch upon said selective engagement of the spring by the device.

8. A mounting assembly as set forth in claim 1, wherein the support further includes a retaining latch for releasably securing the second end of the spring to the support during dismounting of the device so as to relieve the force exerted by the spring on the device through the engagement portion of the spring, the second end of the spring inserted into the retaining latch by selective engagement of the spring by the device.

9. A mounting assembly as set forth in claim 1, wherein the second end of the spring, when released from the set latch, substantially aligns with the retaining latch to be received therein upon dismounting of the device.

10. A mounting assembly as set forth in claim 1, wherein the combination of the support and the spring is configured for insertion as an assemblage through the opening from the front side of the barrier and positioning on the back side of the barrier adjacent to the opening.

11. A mounting assembly as set forth in claim 1, wherein the support is at least partially collapsible for insertion through the opening from the front side thereof and positioning on the back side of the barrier.

12. A mounting assembly as set forth in claim 1, wherein the device is an enclosure for a loudspeaker.

13. A mounting assembly for flush mounting of a device in an opening in a barrier from a front side thereof, the device having a front end configured for exposure on a front surface of the barrier including a surround that is larger than the opening, the assembly comprising:

a support for resting on a surface of the barrier on a back side thereof, the support defining an opening that is configured for positioning around the opening in the barrier; and a pair of springs each having a first end, a second end and an engagement portion intermediate the first end and the second end, the first ends of the springs affixed to the support on substantially opposite sides thereof, the support including a pair of set latches, each set latch releasably securing the second end of one of the springs to the support, the second end of each spring released from its respective set latch by at least partial insertion of the device through the opening from the front side of the barrier and selective engagement of the spring by the device, the device having a pair of clips, each clip engaging one of the springs, whereupon release of the second ends of the springs from the set latches the springs exert forces on the device through the engagement portions of the spring and the clips on the device tending to pull the device through the opening and the surround on the front end of the device into a substantially flush mounted position on the surface of the barrier.

14. A mounting assembly as set forth in claim 13, wherein the springs have a range of motion between a set position in which the second ends of the springs are releasably secured in their respective set latches, and an installed position in which the second ends of the springs are released from their respective set latches and the engagement portions of the springs exert forces on the device tending to pull the device through the opening and into a flush mount on the front surface of the barrier, and the motion of the springs is confined to the back side of the barrier.

15. A mounting assembly as set forth in claim 13, wherein each spring further includes a first spring coil between the first end of the spring and the engagement portion of the spring, the first spring coil exerting a force on the device through the engagement portion of the spring tending to pull the device through the opening and into a flush mount on the front surface of the barrier.

16. A mounting assembly as set forth in claim 15, wherein each spring further includes a second spring coil between the second end of the spring and the engagement portion of the spring, the second spring coil exerting a force tending to move the second end of the spring away from its set latch upon said selective engagement of the spring by one of the clips on the device.

17. A mounting assembly as set forth in claim 13, wherein the support further includes a pair of retaining latches, each retaining latch releasably securing the second end of one of the springs to the support during dismounting of the device so as to relieve the force exerted by the spring on the device, the second end of each spring inserted into its respective retaining latch by selective engagement of the spring by one of the clips on the device.

18. A mounting assembly as set forth in claim 13, wherein the support is substantially planar in configuration.

19. A mounting assembly as set forth in claim 13, wherein the support comprises a plurality of support members that are pivotally joined together in a manner allowing the support to at least partially collapse for insertion through the opening in the barrier from the front side thereof.

* * * * *